US006354440B1

(12) United States Patent
Thöne et al.

(10) Patent No.: US 6,354,440 B1
(45) Date of Patent: Mar. 12, 2002

(54) FACILITY FOR THE SELECTIVE SEPARATION OF A STREAM OF MIXED BULK MATERIALS

(76) Inventors: Carl-Stefan Thöne, Daimlerstrasse 4, 46395, Bocholt; Michael Kühlkamp, Windhuk 6, 48683 Ahaus, both of (DE)

( * ) Notice: Subject to any disclaimer, the term of this patent is extended or adjusted under 35 U.S.C. 154(b) by 0 days.

(21) Appl. No.: 09/624,364

(22) Filed: Jul. 24, 2000

(30) Foreign Application Priority Data

Jul. 26, 1999 (DE) ..... 199 34 960
Mar. 18, 2000 (DE) ..... 200 05 076

(51) Int. Cl.[7] ..... B07C 5/00
(52) U.S. Cl. ..... 209/644; 209/695; 209/925
(58) Field of Search ..... 209/644, 539, 209/695, 925, 932; 198/438, 445

(56) References Cited

U.S. PATENT DOCUMENTS 2,354,419 A * 7/1944 Lingerfelt et al. ..... 209/75
2,417,878 A * 3/1947 Luzietti et al. ..... 209/90
2,645,343 A * 7/1953 Nemir ..... 209/111
2,734,628 A * 2/1956 Schlayer ..... 209/111
2,967,614 A * 1/1961 Nury et al. ..... 209/2
3,049,231 A * 8/1962 Crandall et al. ..... 209/74
3,206,025 A * 9/1965 Ochs ..... 209/88
3,266,627 A * 8/1966 Ochs ..... 209/90
5,248,045 A * 9/1993 Alvelda ..... 209/522
5,819,954 A * 10/1998 Lacriola ..... 209/563
6,062,395 A * 5/2000 Oravetz et al. ..... 209/644
6,145,650 A * 11/2000 Christ et al. ..... 198/493

* cited by examiner

*Primary Examiner*—Christopher P. Ellis
*Assistant Examiner*—Mark J. Beauchaine
(74) *Attorney, Agent, or Firm*—Hoffman, Wasson & Gitler PC

(57) ABSTRACT

A facility for the selective separation of a stream of mixed bulk materials made up of objects of different densities and possibly different sizes comprising a sorting device having at least one conveyor belt on which the stream of mixed bulk materials to be selected is conveyed; and at least one nozzle by means of which compressed air can be blown transversely to the conveying direction and against the stream of mixed bulk materials lying on the conveyor belt, including at least one separating element and at least two collection containers, one of which is placed laterally approximately opposite the nozzle and the other of which is placed in the end region of the conveyor belt.

14 Claims, 4 Drawing Sheets

FACILITY FOR THE SELECTIVE SEPARATION OF A STREAM OF MIXED BULK MATERIALS

RELTAED APPLICATIONS

The present application claims priority to German Patent Application No. 199 34 960.6 filed Jul. 26, 1999 the entirety of which is herein incorporated by reference, and to German Utility Model Application No. 200 05 076.1 the entirety of which is herein incorporated by reference.

BACKGROUND OF THE INVENTION

1. Field of the Invention

The present invention pertains to a facility for the selective separation of a stream of mixed bulk materials made up of objects of different densities and possibly different sizes.

2. The Prior Art

Sorting methods and sorting facilities of the type mentioned above are sufficiently well known in the art. They are used wherever mixtures of various materials are to be sorted into the desired classes, e.g., metal and non-metal materials. In the area of waste recycling in particular, large amounts of recoverable materials have to be separated from one another. In this context, recoverable materials represent all materials that are economical to reuse. With the known sorting methods and facilities, full use is made of the varying properties of the materials, e.g., density, size, magnetic properties, melting point, boiling point, viscosity, etc., in order to be able to separate the stream of recoverable bulk materials into the desired classes of recoverable materials using appropriate filters, generally in several stages.

BRIEF DESCRIPTION OF THE INVENTION

The primary optimization goal of any sorting process of this type is its economic viability, which is ensured by continuous and trouble-free operation of the facility being used. With regard to the media to be sorted, this involves, for example, industrial waste, which forms an extremely inhomogeneous mixture of recoverable materials. Along with solid components, the recoverable materials are loaded with industrial production materials such as oils, greases, chips, etc., which can cause substantial problems in terms of smooth operations if purely mechanical separating is used. The sorting facility has to be shut down if maintenance work is needed, and so is not productive for that period of time.

The task of the present invention consists in making available a facility for the selective separation of a stream of mixed bulk materials made up of objects of various densities and possibly various sizes, in particular, those objects made of relatively high-grade materials, which make recycling appear to be worthwhile, and which operates in a comparatively maintenance-free way.

The execution of this task provides a facility in accordance with the invention for the selective separation of a stream of mixed bulk materials of the type mentioned above. The solution in accordance with the invention takes as its starting point the idea that objects of varying densities can be separated by being struck with compressed air transversely to the conveying direction, due to the fact that they are moved varying distances from their starting point by the compressed air, so that, with the aid of suitable separating elements, the separated objects can subsequently be caught in an appropriate way, individually according to density classes.

If the objects in the stream of mixed bulk materials originally had not just different densities, but different sizes as well, it is advisable to first carry out a presorting on the basis of dimension classes so that in a stream of mixed bulk materials objects are present, which have relatively similar dimensions, and thus differ only in their density. Preferably, a presorting device with at least one screen is used for this presorting.

Preferably, the stream of mixed bulk materials is transported on a conveyor belt with adjustable conveying speed. The striking with compressed air is carried out via a nozzle, which preferably has adjustable pressure and adjustable nozzle flow velocity transversely to the conveying direction, or at least essentially transversely to the conveying direction. That way, the objects are transported varying distances across the conveyor belt, and they are separated with the aid of suitably placed separators when they subsequently move further in the conveying direction, and they can then be caught in various collection containers, whereby preferably one collection container is placed somewhat laterally to the nozzle, which will then hold the objects with the lowest density, since they are the ones transported by the compressed air furthest transversely to the conveying direction. The objects that remain on the conveyor belt can be further separated by means of appropriately placed separating plates, whereby the separating plates are preferably aligned essentially in the conveying direction of the conveyor belt so that the objects in the stream of mixed bulk materials are separated from the standpoint of how far they have moved from their original distance from the nozzle after they have been struck by the compressed air.

Those objects that exhibit the lowest volume weight and are moved by the compressed air to an extent such that they leave the conveyor belt in the transverse direction are preferably braked there by means of an impact plate placed opposite the nozzle where they bounce off and can then be caught in a collection container placed underneath.

With the use of the above-mentioned separating plates for the further separation of the objects that remain on the conveyor belt, the most important feature is that the end at the upstream side of the separating plate is located a distance from the nozzle in the transverse direction such that the desired group of separated objects can be completely collected there during the operation of the conveyor belt. By using this principle, it is thus possible to arrange a number of separating plates at varying distances in the direction transverse to the longitudinal side of the conveyor belt.

If presorting is carried out, for example, by means of a screen, in order to first separate objects of differing sizes, then a metering device placed between the presorting device and the actual sorting device for sorting out objects of varying densities is advantageous in order to act as a buffer, or even to thin out the objects to make the subsequent separation easier. In the same way, a prealignment of the objects of the stream of mixed bulk materials achieved in this way can be advantageous for the subsequent striking by the compressed air.

According to a preferred further development of the invention, a single-layer feeding of the objects of the stream of mixed bulk materials to the sorting device can be achieved by means of scrapers that can be part of the metering device, which also makes the subsequent separating easier.

According to a preferred further development of the invention, the metering device has at least one guide plate combination that is placed downstream of a scraper, preferably with one or more guide plates, which are aligned at an angle to the conveying direction of the stream of mixed bulk materials. This can also be used to delay the forward movement, i.e., a buffer, as well as a thinning out and purposefully directed metering of the objects. For example such a guide plate combination can be used to direct the objects to a closing mechanism, which is preferably located in the region of the downstream end of the metering device. In the closed position of this closing mechanism, any emerging of the stream of mixed bulk materials from the metering device is prevented. As a result, the objects to be separated can be sent from the metering device to the sorting device in batches, for example, to avoid an overloading of the sorting device, or if, for example, a change is desired in the sorting criteria, e.g., by changing the pressure and nozzle flow velocity of the compressed air, and/or changing the position of the separating elements of the sorting device. In this regard, another important variable for controlling the separating process is the feed speed of the conveyor belt. At any given conveyor belt feed speed, the speed of forward movement of the objects can be reduced through the metering device by means of the guide plate combination. By means of a conical, rather funnel-shaped plate combination, which is preferably present in the approach region of the closing mechanism and leads up to it, the objects at the end of the metering device can be sent to the closing mechanism in directed fashion, and a number of the objects can also be collected there.

The presorting discussed above can be carried out in an especially simple and effective way by means of screening. In the case of recoverable materials, which cannot pour through, the screening can be stimulated by means of vibration.

Thinning out of the presorted stream of mixed bulk materials represents another advantageous embodiment of the method according to the invention. Thinning out means that the objects from the stream of mixed bulk materials are sent to the gas mass flow as sequentially as possible. In this way, interference or flow turbulence among the objects in the stream of mixed bulk materials is avoided.

Compressed air is suitable as the gas mass flow, since it can be obtained inexpensively and in any desired amount. For special applications, however, other industrial gases or liquids are also conceivable, e.g., water.

Indexable inserts made of a variety of materials can be separated in an especially effective way by using the method according to the invention, especially sorting on the basis of hard metal versus cermet/ceramic. However, in this context such an application is simply in the nature of an example, and should be used only as an aid to understanding the manner of operation.

It proves to be especially advantageous to place individual functional units ahead of the sorting device. When this is done, a stream of bulk materials that is inhomogeneous in terms of size can first be separated into at least two dimension classes through the use of a presorting device. This proves to be very advantageous with respect to trouble-free selective separation during the subsequent sorting process in accordance with the invention.

In addition, it is extremely advantageous to place a metering device in between, since a buffering and a thinning out of the objects can be completed here. This way, objects from the stream of mixed bulk materials are sent to the sorting device in sequential fashion, and can approach individually and be deflected differently as a result. When a thinned feed is used, diversion effects arising from mutual influencing by the objects while approaching can be avoided.

The use of a screen for presorting represents a simple and cost-effective option for carrying out presorting by size. The components that have been screened out are first caught in a receiving container.

If the stream of mixed bulk materials is being separated into more than two dimension classes, the option exists of placing several screens one above the other, graduated according to the dimension classes. To avoid jamming and to make full use of the entire screen area, it is advantageous to transport the screened-out components from a screening stage to the side of the screen opposite the entry location by means of slides. That way, the entire screen area is better utilized, and the possibility of unintentional dumping out on the entry side is largely excluded.

Stimulation of the screening operation is ensured by a vibrating machine, which vibrates the screen(s) appropriately so that vibration transport of the stream of mixed bulk materials across the screen area is ensured.

As the final stage underneath the screen(s), at least one receiving container is provided, which catches the smallest components of the stream of mixed bulk materials and can function as buffer storage. Moreover, unwanted additions to the stream of mixed bulk materials such as metal chips and other fine-grained components can be caught here.

The transport of the presorted components from the screen via the removal locations to the metering device(s) is advantageously assured by means of slides or conveyor belts. Through a special arrangement and configuration of the slides or conveyor belts, several metering devices and thus several sorting devices can be served at the same time. But temporary storage and a time-shifted sorting of the components presorted by size are also conceivable.

A number of structural designs are conceivable for the metering device. An economical solution is the use of an elevated slide on which at least one scraper, one guide plate, and one vibrating machine are provided. The scraper ensures a feed that is as single-layered as possible. The guide plate or guide plate combination provides for appropriate thinning out and buffering of the components. Buffering proves to be especially advantageous particularly in the case of a discontinuous feed of the stream of mixed bulk materials.

In addition, a metering device that includes at least one conveyor belt, at least one scraper and at least one guide plate is conceivable as well. Even more effective thinning out can be achieved through the combination of several conveyor belts with different conveying speeds.

The use of a closing mechanism represents an additional advantageous option for controlling the material stream. The feed to the downstream sorting device(s) can be controlled through suitable timing.

The use of a final alignment device that is placed above the conveyor belt proves to be especially advantageous. Through its use, the objects moving on the conveyor belt are lined up appropriately on the conveyor belt once again so that the flow from the nozzle can strike them in the best possible way.

As a result of the fact that the sorting device includes an impact plate, which is placed essentially opposite the nozzle, the components that are deflected from the stream of mixed bulk materials across the width of the conveyor belt by the gas mass flow can be caught and can fall into a suitable receiving container.

Those objects, which were deflected less by the gas mass flow because of their greater mass and friction, remain on the conveyor belt and can fall into the receiving container provided at the end for that purpose.

The use of separating plates that are aligned essentially parallel to the conveyor belt's direction of movement is especially advantageous. Through appropriate placing and spacing of the plate(s) relative to one another, a further selection of the objects remaining on the conveyor belt can take place.

Since there are a number of devices located sequentially whose throughputs may vary from one another, it makes a great deal of sense to provide suitable buffer storage areas in order to equalize possible throughput fluctuations during continuous operation.

Along with the pressure parameters of the nozzle (cross section, pressure, gas used), the nozzle flow angle relative to the conveying direction also has a substantial influence on the efficiency of the separation. Through the use of a nozzle with which the direction of the flow can be varied, this angle can be optimally and simply adjusted in an infinitely variable way to the current requirements.

In addition, it is possible to sort the stream of mixed bulk materials by, for example, color when the other properties are the same, for example, through the use of sensors and controlled pulse operation of the nozzle.

BRIEF DESCRIPTION OF THE DRAWINGS

In the following, the present invention is described in more detail by an embodiment with reference to the accompanying drawings. The following are shown.

DETAILED DESCRIPTION OF A PREFERRED EMBODIMENT

Figure 1:
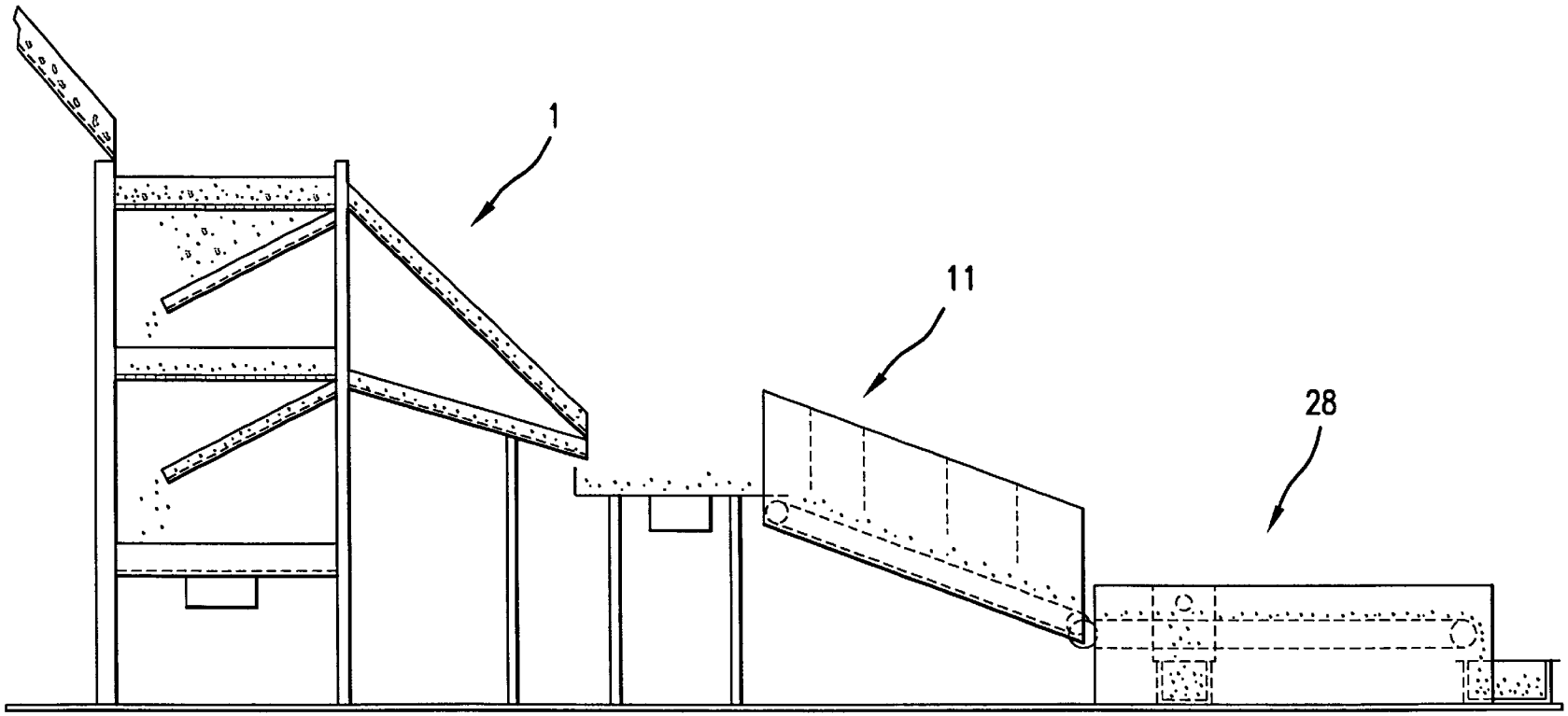
FIG. 1 is an illustration of a sorting facility.

Referring now to FIG. 1, a sorting facility in accordance with the invention is essentially made up of three functional units. They are a presorting device 1, a metering device 11 and a sorting device 28.

The devices cited above perform different tasks within the sorting facility. The sorting process and the technical design of the functional units with the aid of an inhomogeneous mixture made up of indexable inserts as an example of recoverable material, whereby the indexable inserts are to be sorted according to size and materials.

Figure 2:
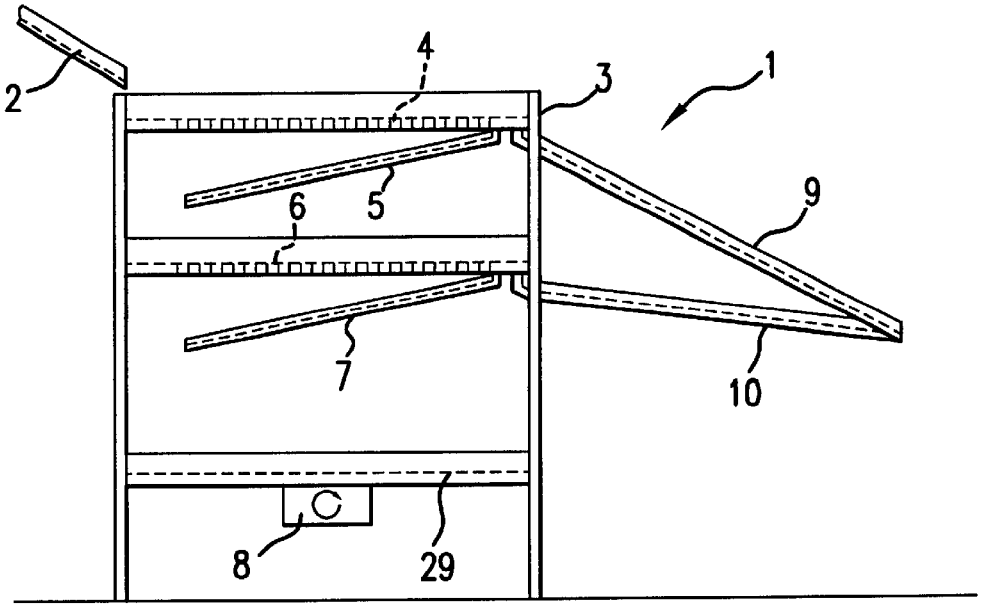
FIG. 2 is a side view of a device for presorting.
Figure 3:
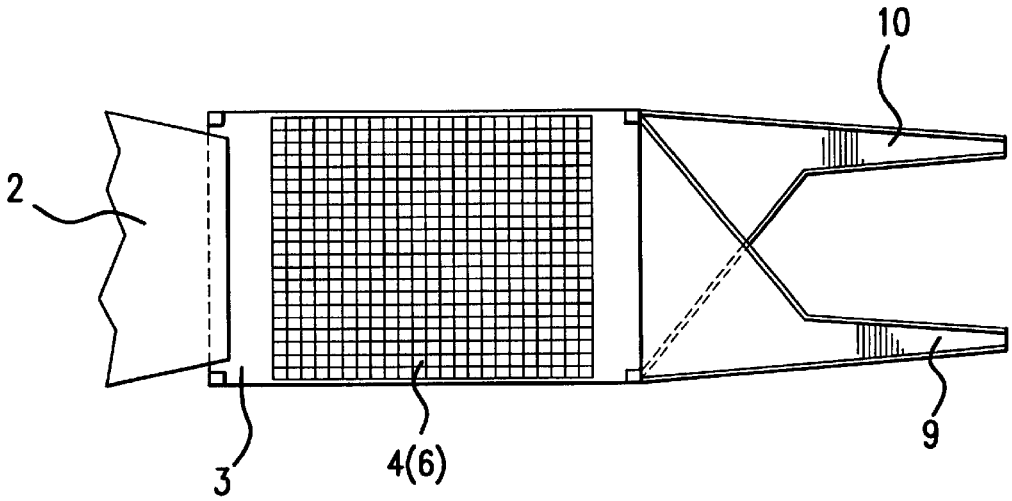
FIG. 3 shows a device for sorting, in plan view.

As can be seen from FIGS. 2 and 3, the presorting device consists in essence of a framework 3 in which two screens 4, 6 are placed one above the other. The hole size and gradation of same can be designed as desired based on the sizes of the recoverable material to be sorted. However, it makes sense to have the hole size of screens 4, 6 decrease in the direction of the force of gravity.

By means of a chute 2, the topmost screen 4 is struck with a mixture of indexable inserts of various materials and sizes, for example, those made of ceramic or hard metal. For better distribution of the indexable inserts over the surface of the screen, the chute 2 can be equipped with a variable scraper or a conveyor belt. Since the recoverable materials mixture made up of indexable inserts does not constitute a form of materials that can be poured, the entire framework 3 has to be made to oscillate by means of a vibrating machine 8. If the screens 4, 6 are placed horizontally, this oscillation leads to an undirected vibration transport, and to a directed vibration transport if the screens 4, 6 are inclined slightly. Depending on their size, as the indexable inserts are being transported across the screens 4, 6, they fall to the next lower screen level or remain at the same level because they are too big for the holes in the screen. Directed vibration transport is also possible when the screens are horizontal. The prerequisite for this is merely the use of a vibration or shaking motion that acts directionally.

In principle, any desired number of screens with decreasing hole sizes placed one above the other is conceivable. The number and gradation has to be adapted to the composition of the mix of recoverable materials to be screened.

As shown in FIG. 2, the indexable inserts do not fall directly onto the next screen; instead they are guided by means of slides 5, 7 to the end of the screens 4, 6 facing the chute 2. This measure avoids allowing the indexable inserts to get to the removal side without appropriate screening, since in this manner they have to cover the entire distance across the screen in question. Accordingly, the smallest indexable inserts are caught in a receiving container 29.

With the arrangement described above for a presorting device 1, the indexable inserts can already be sent to the next functional unit, the metering device 11, in various size classes, as a result of which it becomes possible to ensure a substantially more effective sorting process.

As shown in FIGS. 2 and 3, the transport to the metering device 11 can optionally be carried out via slides 9, 10 or conveyor belts. The shape of the slides is not fixed in advance. The slides shown in FIG. 3 essentially have the shape of two triangles put together, whereby a long side edge points along the screen and an apex points in the direction of the metering device.

In the embodiment present here, two screens 4, 6 and two slides 9, 10 are provided. Accordingly, as a result of the configuration and positioning of the slides 9 and 10, two metering devices 11 and two sorting devices 28 attached to them can be run in continuous operation in parallel. However, a kind of buffer storage between the functional units would also be conceivable, and thus a time-shifted metering and sorting of indexable inserts that have already been presorted by size.

Figure 4:
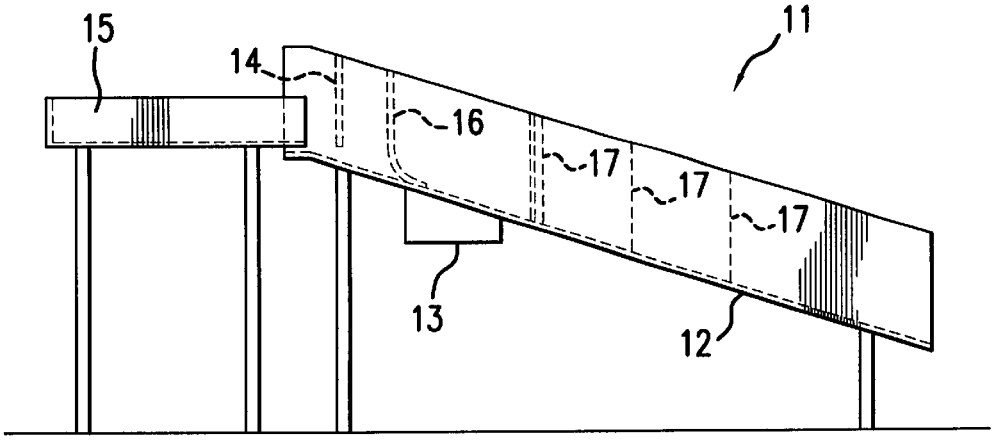
FIG. 4 shows a device for metering, with slide, in side view.
Figure 5:
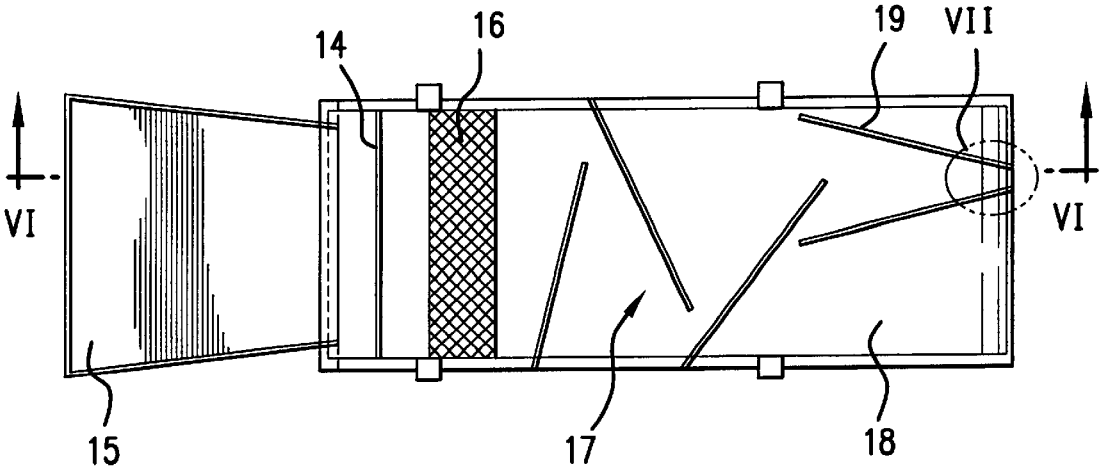
FIG. 5 illustrates a device for metering, with conveyor belt, in plan view.
Figure 6:
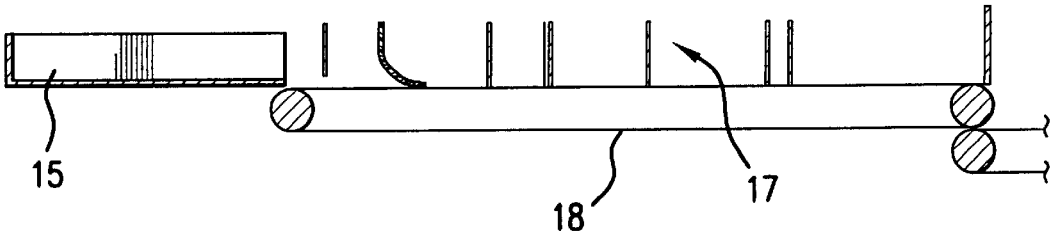
FIG. 6 is a sectional view showing a metering device with conveyor belt taken about line VI—VI of FIG. 5.

As shown in FIGS. 4, 5, and 6, the metering device 11 is used in essence for the buffering plus thinning out and pre-alignment of the indexable inserts that have already been presorted. Several designs are conceivable for this functional unit. Referring now to FIG. 4, a metering device 11, which includes a buffer container 15, a slide 12, a rigid scraper 14, a fabric scraper 16, a combination of guide plates 17 and a vibrating machine 13.

The presorted indexable inserts fall from the buffer container 15 onto the indicated slide 12 and are then transported by the vibration of the vibrating machine 13 to the lower end of the slide 12. In doing that, they pass a scraper combination consisting of one rigid scraper 14 and a fabric scraper 16. As a result of a following guide plate combination 17 of variable size, shape, and number of plates with varying adjustment angles, a thinning out of the indexable inserts can be achieved because of the different running speeds of the indexable inserts at the plates 17 in question. At the same time, the plates 17 bring about a buffering, which is desirable with discontinuous feeding of the material, for example. Because of the combination of the mechanisms and the slide as such, made available at the end are thinned and pre-aligned indexable inserts, which can be separated into metal and ceramic indexable inserts in the next functional unit, the sorting device 28.

Figure 7:
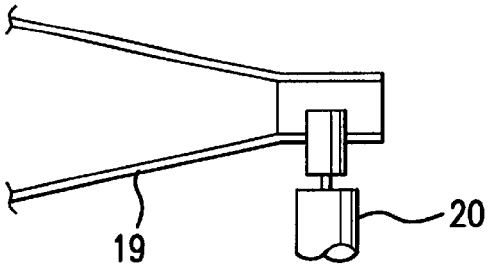
FIG. 7 is a plan view of a closing mechanism taken at Section VII of FIG. 6.

As an alternative to the configuration described above, the use of a conveyor belt 18 is conceivable, with comparable thinning devices 14, 16 and 17 fitted above its running surface. The presorted indexable inserts get onto the conveyor belt 18 either directly from one of the slides 9, 10 or from a buffer container. As a result of the variable scraper combination, consisting of a rigid scraper 14 and a fabric scraper 16, a feeding of the indexable inserts that is as single-layered as possible is ensured to the following guide plate combination 17. Here as well, as a result of the following guide plate combination 17 of variable size, shape, and number of plates, through varying adjustment angles and a resultant different running speed of the indexable inserts at the plates 17 in question, a thinning out of the indexable inserts with simultaneous buffering can be achieved, for example, in the case of discontinuous feed. If necessary, the separation at the plates 17 can be further increased through combination with several conveyor belts with varying running speeds or through the use of an additional, timed closing mechanism per FIG. 7. The closing mechanism consists in essence of a funnel-shaped plate combination 19 and a hydraulic closing mechanism 20. Hydraulic control is not absolutely essential. It is also feasible, for example, to employ a magnet-spring combination or a pneumatic control using the compressed air available for the sorting nozzles.

Figure 8:
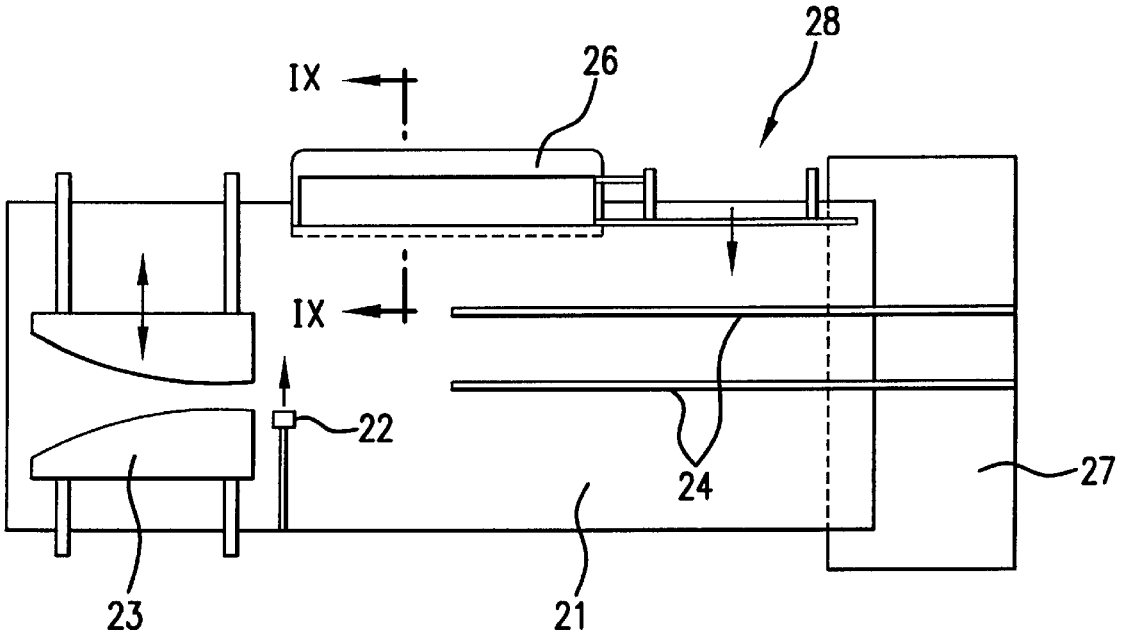
FIG. 8 illustrates a sorting device in plan view.
Figure 9:
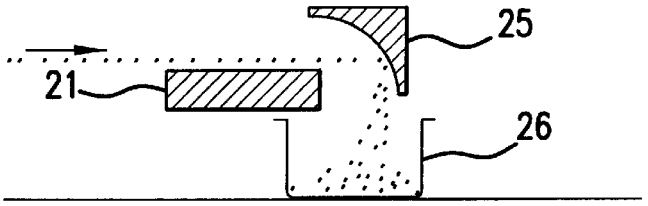
FIG. 9 is a sectional view IX—IX of a sorting device taken about line IX—IX of FIG. 8.

Referring now to FIG. 8, the thinned indexable inserts are transported to the sorting device 28. The sorting device 28 consists in essence of a conveyor belt 21, a funnel-shaped final alignment device 23, a nozzle 22, an impact plate 25, separating plates 24, and receiving containers 26 and 27. With regard to conveyor belts 18 (metering) and 21 (sorting), it is not absolutely essential that two conveyor belts be involved. For example, if it is possible to dispense with different belt running speeds because with the material in question the separating done by the guide plate combination 17 is sufficient, it is advisable to use one conveyor belt of the corresponding length.

The indexable inserts that get onto the conveyor belt 21 thinned by the metering device 11 are brought into the desired position on the conveyor belt 21 by the final alignment device 23. The actual sorting operation is carried out through the effect of compressed air. A nozzle 22, which is mounted downstream of the final alignment device 23 and transversely to the conveying direction, blows compressed air at an adjustable pressure and flow speed against the indexable inserts lying on the conveyor belt 21. In general, an operating pressure of 3 to 4 bar and a nozzle diameter of 0.8 to 1 mm are used. Pressure and diameter apply only to the prototypes presently in use. They can vary in other facilities depending, for example, on the conveyor belt covering and size. By setting these parameters appropriately, the indexable inserts can be struck by the flow transversely to the conveying direction in such a way that the light indexable inserts based on ceramic hit the impact plate 25 and are caught in the collection container 26. The generally heavier indexable inserts based on hard metal are deflected less strongly by the flow of air, so that they proceed further on the conveyor belt 21 and are caught in the collection container 27 at the end.

In addition, through appropriate alignment, the separating plates 24 offer the option of sorting the hard metal indexable inserts according to additional weight classes.

What is claimed is:

1. A facility for the selective separation of a stream of mixed bulk materials made up of objects of different densities and possibly different sizes comprising:

a sorting device having at least one conveyor belt on which the stream of mixed bulk materials to be selected is conveyed; and at least one nozzle by means of which compressed air can be blown transversely to the conveying direction and against the stream of mixed bulk materials lying on the conveyor belt, including at least one separating element and at least two collection containers, a first collection container is placed laterally approximately opposite the nozzle and a second collection container is placed at an end region of the conveyor belt.

2. A facility according to claim 1, wherein:

the conveyor belt further includes adjustable conveying speed.

3. A facility according to claim 1, wherein:

the nozzle further includes adjustable pressure and adjustable flow speed.

4. A facility according to claim 1, wherein:

one of the separating elements is an impact plate which is placed opposite the nozzle in such a way that a separated portion of the stream of mixed bulk materials hits the impact plate and is caught in the first collection container.

5. A facility according to claim 4, wherein:

at least one of the separating elements is a separating plate, which is at least partially aligned essentially in the conveying direction of the conveyor belt.

6. A facility according to claim 5, wherein:

multiple separating plates are provided at different distances in the transverse direction from the longitudinal side of the conveyor belt.

7. A facility according to claim 6, wherein:

said facility further includes a final aligning device, which narrows the stream of mixed bulk materials is placed upstream of the nozzle.

8. A facility according to claim 7, wherein:

at least one presorting device is placed ahead of the sorting device and said presorting device includes at least one screen for separating objects of varying sizes from the stream of mixed bulk materials.

9. A facility according to claim 8, wherein:

at least one metering device for buffering, thinning out, and aligning the objects of the stream of mixed bulk materials is placed in the flow path between the presorting device and at least one screen.

10. A facility according to claim 9, wherein:

the metering device includes one or more scrapers for achieving a single-layered feed of the objects of the stream of mixed bulk materials.

11. A facility according to claim 10, wherein:

the metering device exhibits at least one guide plate combination located downstream of a scraper and hav ing one or more guide plates, which are aligned at an angle to the conveying direction of the stream of mixed bulk materials.

12. A facility according to claim 11, wherein:

the metering device exhibits at its downstream end a closing mechanism, which in the closed position prevents any emerging of the stream of mixed bulk materials from the metering device.

13. A facility according to claim 12, wherein:

the closing mechanism is a somewhat funnel-shaped plate combination, which runs toward the approach region in a conical fashion.

14. A facility for the selective separation of a stream of mixed bulk materials according to claim 13, wherein:

the selective separation of objects with varying densities, including a presorting device for the separating of objects with varying sizes, and including a metering device, which is placed in the flow path between the presorting device and the sorting device and exhibits at least one closing mechanism, which in the closed position prevents any emerging of the stream of mixed bulk materials from the metering device.

* * * * *